US006919804B1

(12) United States Patent
Cook et al.

(10) Patent No.: US 6,919,804 B1
(45) Date of Patent: Jul. 19, 2005

(54) PASSENGER DETECTION SYSTEM FOR VEHICLES

(75) Inventors: Kenneth J. Cook, Troy, MI (US); Jessie D. Swinea, Jr., Royal Oak, MI (US)

(73) Assignee: Vultron Incorporated, Auburn Hills, MI (US)

( * ) Notice: Subject to any disclaimer, the term of this patent is extended or adjusted under 35 U.S.C. 154(b) by 0 days.

(21) Appl. No.: 10/265,020

(22) Filed: Oct. 4, 2002

Related U.S. Application Data

(63) Continuation-in-part of application No. 09/851,243, filed on May 8, 2001.

(51) Int. Cl.[7] ..... G08B 13/00

(52) U.S. Cl. ..... 340/541; 340/545.3; 340/556; 340/565

(58) Field of Search ..... 340/541, 545.3, 340/551, 552–556, 565

(56) References Cited

U.S. PATENT DOCUMENTS

| | | | | |
|---|---|---|---|---|
| 3,997,866 A | * | 12/1976 | Taylor et al. | 367/102 |
| 4,356,387 A | * | 10/1982 | Tsubota et al. | 377/6 |
| 4,528,679 A | | 7/1985 | Shahbaz et al. | 377/6 |
| 4,847,485 A | * | 7/1989 | Koelsch | 250/221 |
| 5,068,537 A | * | 11/1991 | Ishikawa et al. | 250/342 |
| 5,138,638 A | | 8/1992 | Frey | 377/6 |
| 5,149,921 A | | 9/1992 | Picado | 187/130 |
| 5,305,390 A | * | 4/1994 | Frey et al. | 382/2 |
| 5,313,060 A | | 5/1994 | Gast et al. | 250/221 |
| 5,485,347 A | | 1/1996 | Miura | 702/128 |
| 5,541,414 A | | 7/1996 | Hori | 250/349 |
| 5,866,887 A | * | 2/1999 | Hashimoto et al. | 235/98 R |
| 5,920,057 A | * | 7/1999 | Sonderegger et al. | 235/384 |
| 5,973,732 A | * | 10/1999 | Guthrie | 348/169 |
| 6,388,573 B1 | * | 5/2002 | Smith et al. | 340/556 |

OTHER PUBLICATIONS

"Automatic Passenger Counting", Urban Transportation Associate, Inc.

"U–Gage™ T30 Series with Dual Discrete Outputs–Ultrasonic Sensors with TEACH–Mode Programming", Banner Engineering Corp.

"MINI–ARRAY® Measuring Light Screen System (MAC Series Controller) Instruction Manual", Banner Engineering Corp.

"Passenger Counting System", INIT GmbH Innovations in Transport, Apr. 1999.

* cited by examiner

*Primary Examiner*—Toan N. Pham
(74) *Attorney, Agent, or Firm*—Bliss McGlynn, P.C.

(57) ABSTRACT

A passenger detection system is provided for a vehicle having at least one opening to allow passengers to enter and exit the vehicle. The passenger detection system includes a plurality of passenger detection devices placed on opposed sides of the at least one opening to detect passengers entering and exiting the vehicle through the at least one opening. The passenger detection system also includes a plurality of passenger number devices placed on at least one side of the at least one opening to detect the number of the passengers entering or exiting the vehicle through the at least one opening.

20 Claims, 4 Drawing Sheets

PASSENGER DETECTION SYSTEM FOR VEHICLES

CROSS-REFERENCE TO RELATED APPLICATION(S)

The present application is a continuation-in-part of copending U.S. patent application Ser. No. 09/851,243, filed May 8, 2001.

BACKGROUND OF THE INVENTION

1. Field of the Invention

The present invention relates generally to vehicles and, more specifically, to a passenger detection system for a vehicle.

2. Description of the Related Art

For use in public transportation systems and other types of mass transit scenarios, it is known to provide passenger detecting systems within the transport vehicles. Typically, the passenger detecting system is installed in a vehicle to count passengers entering or exiting an opening of the vehicle. The detecting system generally operates in a passive, stand-alone mode with some variations used to communicate with other on-board devices. The conventional passenger detecting system includes a beam of light such as an infrared light that is projected across the opening of the vehicle and is broken by a passenger entering or exiting the vehicle through the opening. When the beam of light is broken, a signal is sent to a microprocessor that records or counts the passenger.

One disadvantage of the above passenger detecting system is that it does not know if the passenger is entering or exiting the vehicle to keep track of how many passengers are in the vehicle. Another disadvantage of the known passenger detecting system is that it cannot tell if more than one passenger entered or exited the vehicle at the same time. Additionally, the current passenger detection systems have the disadvantage of not being integrated with other system technologies that can provide more than just simple raw numbers of passengers or pass that information to where it is most useful. For example, it is desirous not only to know the number of passengers on the transport vehicle at any given time while in route but to also relay this information to a central dispatch or control center. This is true of other corresponding information as well, including but not limited to, the vehicle's actual location along the route, the numbers of passengers boarding or leaving at each of the route stops, any deviations of the vehicle from its prescribed route, and real time video images of the passengers from within the vehicle itself.

Conventional passenger counting or detection systems are incapable of integrating and processing these varying types of information from the vehicle and its surroundings into a usable and transferable format for use by the transportation system controllers. Thus, to accomplish a usable integration of these different types of information, a microprocessor controlled passenger detecting system that is capable of processing and routing data between vehicle systems, as well as in and out of the vehicle, to and from remote systems is required. Therefore, not only is there a need in the art to provide a passenger detection system that is capable of accurately detecting one or more passengers entering and exiting the vehicle, but there is also a need in the art for a microprocessor controlled passenger detection system that can integrate other on-board systems, process the data, and communicate with a remote system.

SUMMARY OF THE INVENTION

Accordingly, the present invention is a passenger detection system for a vehicle having at least one opening for passengers to enter and exit the vehicle. The passenger detection system includes a plurality of passenger detection devices placed on opposed sides of the at least one opening to detect passengers entering and exiting the vehicle through the at least one opening. The passenger detection system also includes a plurality of passenger number devices placed on at least one side of the at least one opening to detect the number of the passengers entering or exiting the vehicle through the at least one opening.

One advantage of the present invention is that a passenger detection system is provided for a vehicle such as a bus to detect whether passengers are entering or exiting the vehicle. Another advantage of the present invention is that the passenger detection system detects one or more passengers entering or exiting the vehicle at the same time allowing accurate detection of passengers entering or exiting a vehicle at a relatively low cost. Yet another advantage of the present invention is that the passenger detection system is integrated with other systems and vehicle devices and has the ability to process data from those sources and be networked with a remote location to send and receive data.

Other features and advantages of the present invention will be readily appreciated, as the same becomes better understood, after reading the subsequent description when taken in conjunction with the accompanying drawings.

DESCRIPTION OF THE PREFERRED EMBODIMENT(S)

Figure 1:
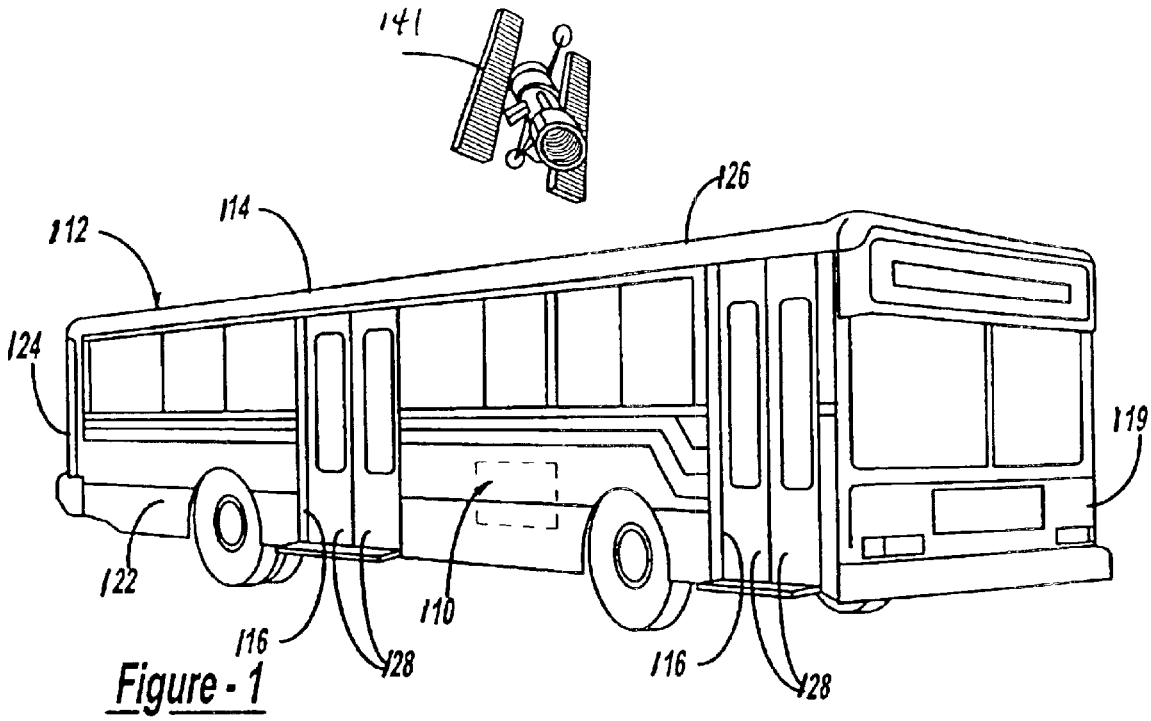
FIG. 1 is an elevational view of a passenger detection system, according to the present invention, illustrated in operational relationship with a vehicle.
Figure 4:
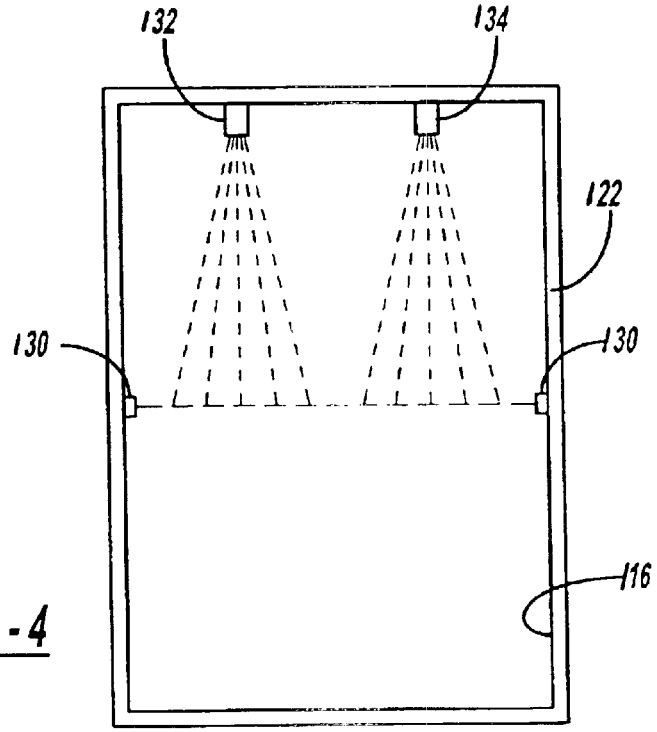
FIG. 4 is an elevational view of a portion of the passenger detection system of FIG. 3.
Figure 2:
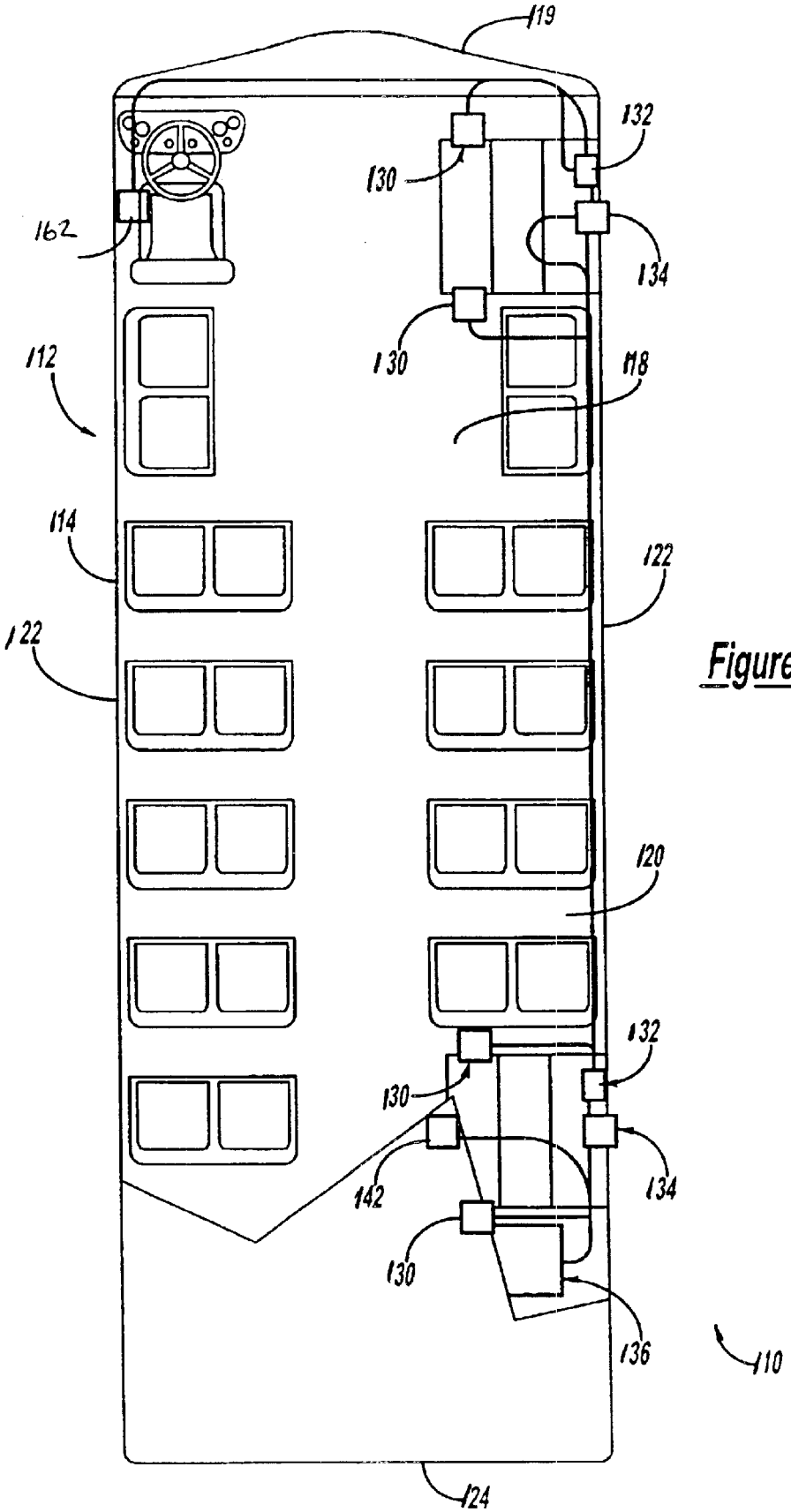
FIG. 2 is a plan view of the passenger detection system and vehicle of FIG. 1.

Referring now to the drawings and in particular FIGS. 1 and 2, one embodiment of a passenger detection system 110, according to the present invention, is illustrated in connection with a vehicle, generally indicated at 112, such as a bus. Such vehicles 112 typically include a vehicle body 114 having one or more openings 116 forming a passenger interior 118. The vehicle body 114 includes a front 119, a floor 120, two opposed sides 122, a rear 124, and a roof 126 which define the passenger interior 118. The vehicle 112 includes a pair of moveable doors 128 at each opening 116 that open and close the openings 116. The passenger detection system 110 detects passengers entering and exiting the vehicle 112 through the openings 116. It should be appreciated that, except for the passenger detection system 110, the vehicle 112 is conventional and known in the art. It should also be appreciated that the passenger detection system 110 may be used for other vehicles such as rail cars for a train or subway.

Referring to FIGS. 1 through 4, the passenger detection system 110 includes a plurality, preferably a pair, of passenger detection devices 130 on opposed sides of each opening 116. The passenger detection devices 130 are either of an infrared or ultrasonic type. In the embodiment illustrated, the passenger detection devices 130 are infrared sensors acting as an emitter and a receiver and having an array of infrared light beams extending therebetween across each of the openings 116. The infrared sensors are known as MINI-ARRAY® Systems, which are commercially available from Banner Engineering Corp., of Minneapolis, Minn. It should be appreciated that the passenger detection devices 130 detect whether a passenger enters or exits the passenger interior 118 through the opening. 116 by which infrared beam is broken first.

The passenger detection system 110 also includes a plurality of, preferably first and second passenger number or counting devices 132 and 134, respectively, at each of the openings 116 to detect the number of passengers entering and/or exiting the passenger interior 118 of the vehicle 112. Each of the passenger number devices 132 and 134 are of an ultrasonic type. The ultrasonic sensors are known as U-GAGE™ T30 Series with Dual Discrete Outputs, which are commercially available from Banner Engineering Corp., of Minneapolis, Minn. The ultrasonic sensors have an ultrasonic ranging beam pulse higher than the human hearing range such as 32 kHz. The passenger number devices 132 and 134 are located either above each opening 116 and spaced longitudinally or offset from each other or preferably on opposed sides of each opening 116 and spaced longitudinally or offset from each other. The passenger number devices 132 and 134 are angled downwardly and set to specific window size to prevent overlapping. It should be appreciated that the passenger number devices 132 and 134 detect the number of passengers entering and/or exiting the interior 118 of the vehicle 112 through the opening 116.

Figure 3:
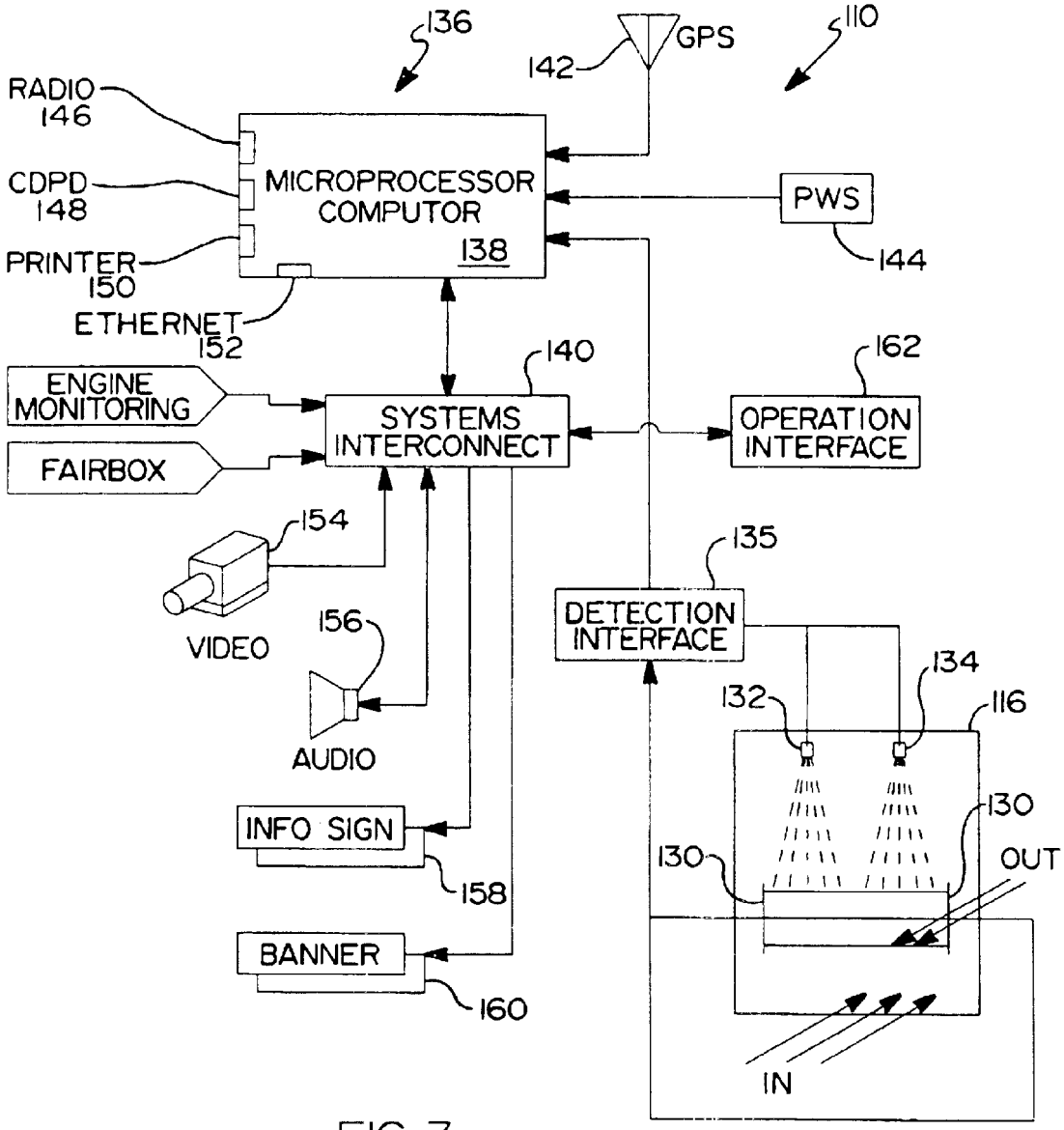
FIG. 3 is a diagrammatic view of the passenger detection system of FIGS. 1 and 2.

The passenger detection system 110 also includes a detection interface 135 electrically interconnecting the passenger numbering devices 130, 132, and 134 and the computer 38 of the computer system 36. As shown in FIG. 3, the passenger detection system 110 includes a microprocessor computer control system, generally indicated at 136, electrically connected to the passenger detection devices 130 and passenger number devices 132 and 134 through a detection interface 135 to determine the number of passengers within the passenger interior 118 of the vehicle 112. The detection interface 135 is a dedicated latching and storing circuit used to capture signals from the passenger numbering devices 130, 132, and 134.

The computer control system 136 includes a microprocessor computer unit 138, a systems interconnection box 140, a global positioning satellite (GPS) antenna 142, a power source 144, a vehicle radio interconnection port 146, a CDPD (Cellular Digital Packet Data) modem interconnection port 148, a parallel printer port 150, and an Ethernet network interconnection port 152. The computer control system 136 further includes certain external devices. In the preferred embodiment these external devices include, but are not limited to, one or more video cameras 154, an audio interface device 156, one or more banner advertisement signs 160, one or more passenger information signs 160, and an operator interface unit 162.

The systems interconnection box 140 provides a centralized point, or junction, for the electrical interconnection of the external devices to the microprocessor computer unit 138. Thus, the systems interconnection box 140 is electrically connected to the one or more video cameras 154, the audio interface device 156, the one or more passenger information signs 158, the one or more banner advertisement signs 160, and the operator interface unit 162.

The operator interface unit 162 is used to display information to the operator of the vehicle and also allow the operator to input information to the computer control system 136. In the one embodiment, the operator interface unit 162 may be of a touch-screen type to allow direct physical input of information into the computer unit 138, while displaying a visual output. In another embodiment, the operator interface unit 162 may include a keyboard and mouse or trackball. It should be appreciated that the keyboard and mouse may be separate or integrated within the operator interface unit 162.

The one or more video cameras 154 are used for monitoring and recording passengers within the passenger interior 118. The one or more passenger information signs 158 are used to display messages in both English and foreign languages both inside the passenger interior 118 and externally on the exterior of the vehicle 112. The messages displayed by the passenger information signs 158 relate to route and stop information and vehicle capacity. For example, the route assigned to the vehicle 112, the next stop on its route, if the vehicle's passenger compartment is full, or the like. The one or more banner advertisement signs 160 also display messages in different languages and are located within the interior and upon the exterior of the vehicle 112. However, the messages displayed by the banner advertisement signs 160 relate to public service information and commercial advertisements for products and services.

The audio interface device 156 is located within the passenger compartment and used to announce messages to the passengers. It may be solely an output device such as a speaker, or it may also have an input device (i.e., a microphone). In this manner, the audio interface device 156 may be used, as are the video cameras 154, for monitoring and recording passengers within the passenger interior 118. It should be appreciated that the cameras 154, audio interface device 156, signs 158, and banners 160 and are preferred, but optional.

Additionally, the systems interconnection box 140 is electrically connected to, and receives inputs from, the fairbox and engine monitoring systems (not shown) of the vehicle 112 that provide additional passenger/ridership information, and health monitoring of the vehicle 112.

The global positioning satellite (GPS) antenna 142 is electrically connected to the computer unit 138 for receiving signals from a GPS 141 allowing the computer control system 136 to be constantly updated on the physical location of the vehicle 112. A power source 144 such as the vehicle electrical system and/or a separate battery, or power supply system is electrically connected to the computer unit 138 and devices 130, 132, 134. The power source 144 supplies keep-alive voltages to the microprocessor control system 136 when the vehicle 112 is not running.

Figure 5:
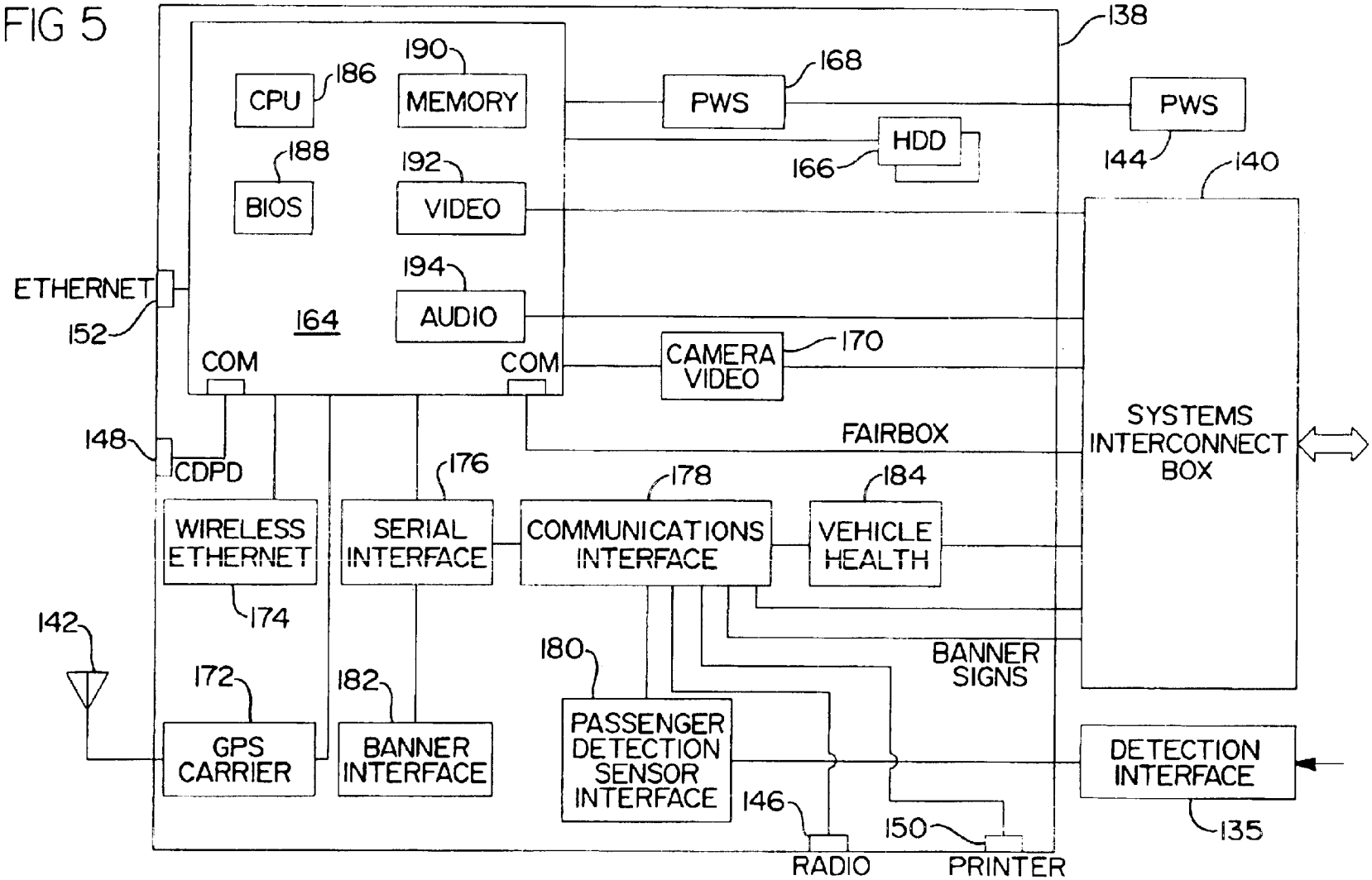
FIG. 5 is a block diagram of a microprocessor computer unit, according to the present invention, of the passenger detection system of FIGS. 1 through 3.

The computer control system 136, as illustrated in FIG. 5, includes a main motherboard 164, one or more hard drives 166, a power supply 168, a video camera controller device 170, a GPS interface device 172, a wireless Ethernet interface device 174, a serial data interface device 176, a communications interface device 178, a passenger detection sensor interface device 180, banner advertisement sign interface devices 182, and a vehicle health circuit card 184.

In the preferred embodiment, the main motherboard 164 and the various other components of the computer unit 138 may be of a known commercially available construction, based on any of the currently available known microprocessor integrated circuit "IC" chips, also known as a CPU (computer processing unit). For example, the main motherboard may employ one of a type of CPU 186 of any the various types manufactured by Intel, AMD, or Apple. Regardless of the origin of manufacture, the computer architecture employs the known and generalized internal structure having three major components: an arithmetic logic unit, a control unit, a clock, or timing unit that utilize internal registers to control and manipulate data. The benefit to the use of a known microprocessor motherboard is in the cost effective off-the-shelf availability of components and the ease of maintenance and repair of the system. It should be appreciated that a specifically designed main motherboard could also be employed but at generally higher construction and maintenance costs.

The main motherboard 164 employs a "built-in-operating-system" (BIOS) integrated circuit 188 that is used to initialize the CPU 186 and its various support circuitry when power is applied to the system. Additionally, the main motherboard 164 includes memory integrated circuits 190. The memory integrated circuits 190 may be of a known plug-in type or may be operatively attached directly to the motherboard 164. The main motherboard memory 190 may be either one of the two general types of memory devices, or both types may be used based on the desired functionality of the microprocessor. In the preferred embodiment, the computer control system 136 employs both ROM (read-only-memory) and RAM (random-access-memory). The ROM has a set of instructions burned into its circuitry and permanently retains the required instructions for start-up and initialization of the main motherboard 164 and CPU 186, in conjunction with the BIOS 188. The RAM being of a volatile, or semi-permanent and changeable storage nature, is loaded upon system start-up with software instructions and data to be used by the CPU 186. The RAM also holds the resultant processed data and control signals that the CPU produces during the course of its operation.

The instructions and data that are loaded into the memory 190 may be software programs of either a known and existing type obtained through outside parties or may be software programming of a proprietary nature designed and created specifically for this application. It should be appreciated that the software programming may take the form of loadable software that is external to the main motherboard 164, or it may take the form of a permanently loaded firmware that remains resident in the microprocessor CPU 186, the BIOS 188, or the ROM memory 190, or portions of each.

The main motherboard 164 includes a video display circuit 192, which is used to produce the signals necessary to drive the display of the operator interface unit 162. The output of the video display circuit 192 is routed through the systems interconnection box 140. It should be appreciated that the video display circuit 192 may be either a dedicated circuit directly disposed upon the main motherboard 164 or a separate dedicated circuit card that plugs into or otherwise electrically connects to the main motherboard 164. The main motherboard 164 also includes an audio driver circuit 194, which is used to process the output signals to drive the audio interface device 156, which generates messages to the passengers, it also processed any audio signals received from microphones within the vehicles interior. The audio signals used by the audio driver circuit 194 are routed through the systems interconnection box 140. It should be appreciated that the audio driver circuit 194 may be either a dedicated circuit directly disposed upon the main motherboard 164 or a separate dedicated circuit card that plugs into or otherwise electrically connects to the main motherboard 164.

When software storage is required, the at least one hard drive 166 is provided for digital data storage. The data on the hard drive 166 may be loaded and stored prior to the hard drive 166 being installed within the computer control system 136 or the data and programs may be stored, or updated to the hard drive 166 during periodic maintenance. As discussed above, the stored software and data may take the form of operating system software for the CPU 186 and main motherboard 164, applications software for the attached hardware devices, and data analysis and processing software for use by the operator, the dispatch, or the network. The processed and recorded data, such as passenger counting, vehicle tracking along the route, system and vehicle health monitoring, recorded video from within the vehicle, or the like, may be dynamically stored on the hard drive 166 while the vehicle is operating. At least one, preferably two hard drives 166 are used as in the preferred embodiment, thereby allowing greater storage capacity, an ability to separate the data and programs, and offering a redundancy for hard drive failures while the vehicle 112 is operating.

The internal power supply 168 is provided that takes a power input from the vehicle power source 144 and filters and regulates the input power to the necessary voltages and ground returns needed by the computer unit 138 and the system devices to operate. The provided voltages may be +24Vdc, +12Vdc, −12Vdc, +5Vdc, and −5Vdc, or any other that may be required by the system and the attached devices.

The video camera controller device 170 is a circuit board dedicated to control the video cameras and route the video signals to the computer unit 138. The video camera controller device 170 is electrically connected to the video cameras 154 through the systems interconnection box 140. Depending on the types of video cameras desired within the application, the video camera controller device 170 may be required to convert analog video signals to digital signals for data processing and storage. Additionally, it may be desired to control the direction of the video cameras or to zoom the camera lenses; the video camera controller device 170 also handles these tasks.

The GPS interface device 172 is a circuit board dedicated to receiving GPS data and converting it to a format that is usable by the computer unit 138. The GPS interface device 172 is electrically connected to the GPS antenna 142 for receiving real time vehicle location inputs from a GPS 141.

The wireless Ethernet interface device 174 is a circuit board dedicated to receiving and transmitting data from the microprocessor system to other Ethernet network devices remote from the vehicle 112. The wireless Ethernet antenna 142 is electrically connected to the computer unit 138 for communication with a wireless Ethernet networking system (not shown). The communication to a wireless Ethernet network can be used to interconnect, or network, all the computer control systems 136 of all vehicles 112 within a fleet of vehicles to each other and to a central dispatching, or control computer.

In the preferred embodiment, the wireless Ethernet interface device 174 is electrically connected to the main motherboard 164 and includes a PCMCIA type self-contained wireless Ethernet interface card. The designation PCMCIA is a known standard derived from the Personal Computer Memory Card International Association, which is an international standards body and trade association that has set established standards for mobile Integrated Circuit cards.

Additionally, the Ethernet network interconnection port 152 is an external Ethernet port in RJ-45 standard to allow cabled interconnection to other on-board computer networkable systems or devices that may be added within the vehicle 112. This RJ-45 port is electrically connected to the main motherboard 164 of the computer unit 138 and is distinct from the wireless Ethernet interface device 174, however it allows an Ethernet interface from any external networkable devices to the Ethernet system through the computer control system 136 and the wireless Ethernet interface device 174.

The serial data interface device 176 is a circuit card dedicated to interfacing some of the external devices with the main motherboard 164 and the CPU 186. The serial data interface device 176 routes the various control and data signals from the main motherboard 164 out to the external devices and back again by creating serial data streams of the information and passing them along the standard serial bus data lines of the computer control unit 138.

In reference to the flow of data, the communications interface device 178 is in electrical connection between the serial data interface device 176 and the majority of active devices, components, and connectors in the computer control system 136. The communications interface device 178 is a dedicated circuit card that acts to convert the analog data produced by the active components to digital data, which then allows the serial interface device 176 to encode the digital information into a serial data stream for use by the main motherboard 164 and the CPU 186. The communications interface device 178 also performs a digital to analog data conversion as data and control signals are routed out from the CPU 186 through the serial interface device 176 to the analog devices.

Additionally, the communications interface device 178 is capable of supplying power to the active components as required. In other words, if an active device within the system 110 utilizes signals of an analog nature or requires that voltage be supplied by the computer unit 138 then the signal flow and/or voltage is routed through the communications interface device 178 to that device or component. Specifically, the active devices or connections that use the communications interface device 178 to communicate with serial interface device 176 and the main motherboard 164 are the vehicle radio interconnection port 146, the parallel printer port 150, the passenger information signs 158, the banner advertisement signs 160, the passenger detection sensor interface device 180, and the vehicle health circuit card 184.

The vehicle radio interconnection port 146 allows interconnection with a known radio communications system (not shown) located within the vehicle 112. The radio communications system is of the type already in use in mobile communications and often employed in fleet vehicle operations. The vehicle radio interconnection port 146 routes audio analog signals derived from radio communications between the vehicle operator and the dispatch, or control center, or another fleet vehicle. The analog radio signals are converted to digital signals by the communications interface device 178, routed through the serial interface device 176 and processed and stored by the CPU 186 on the hard drives 166. This allows storage of all radio communications to and from the vehicle 112 for analysis or reference at a later date. It should be appreciated that the computer unit 138 has the appropriate software loaded that would allow such operations to occur.

The parallel printer port 150 is of a known standard design. The communications interface device 178 uses the parallel printer port 150 to allow the control computer unit 138 to electrically connect to an external printer (not shown), which allows data to be output in hardcopy format from the control computer unit 138. The printer output may then be used for analysis of vehicle movements, routing, passenger ridership, vehicle performance, maintenance, or the like.

The passenger detection sensor interface device 180 is a dedicated circuit card that receives and processes passenger detection data from sensors 130, 132, and 134 that is routed through the detection interface 135 to determine, as discussed above, passenger count and recognize the entering and leaving of the detected passengers. The signals from the sensors are received and processed by the sensor interface device 180 and routed to the communications interface device 178 for conversion to digital data. Then, the digital signals are passed to the serial interface device to be placed in a serial data stream and sent to the main motherboard 164 and the CPU 186.

The vehicle health circuit card 184 receives and processes the raw data sent from a number of vehicle sensors (not shown). The signals are processed at the vehicle health circuit card 184 and routed to the communications interface device 178 for conversion to digital data. Then, the digital signals are passed to the serial interface device 176 to be placed in a serial data stream and sent to the main motherboard 164 and the CPU 186.

The output to the passenger information signs 158 is controlled by the CPU 186 and the main motherboard 164 as dictated by the software that is loaded into the control computer unit 138. Manual operator inputs are additionally available through the operator interface unit 162. It should be appreciated that the software may use a variety of system inputs to determine the nature of the output signals to the signs. Changes to the displayed information may be predetermined or selectable by the operator or through the external network connection to the dispatch control. For example, if the output display is to inform passengers of the next stop along the route, then inputs relating to the present location of the vehicle 112 are cross-referenced to stored data that specifies the planned stops and knows the locations of them along the route. Additionally, the estimated time to the next stop can be calculated and displayed by using the next stop data, calculating the distance to the next stop, and sensing or calculating the present speed of the vehicle. Also, the output sent to a passenger information sign 158 that is disposed upon the outside of the vehicle may be different than that sent to a passenger information sign 158 that is on the inside of the vehicle. Other types of information can be sent to the outside located sign 158. For example, that the vehicle 112 is full to capacity, or the planned route of the vehicle, or the next stop data, which would help ensure that oncoming passengers are boarding the right vehicle.

The output to the passenger information signs 158 is sent out from the CPU 186 to the serial interface device 176 in a data stream. The serial interface device 176 routes the signals to the communications interface device 178, which then provides the data and power, as required, to the signs 158.

The banner advertisement signs 160 are similarly driven; however, they require additional circuitry to create specialized types of displays in accordance with their application as advertising display devices. For example, the banner signs 160 may be of a known type that is a scrolling text display, or the banner signs 160 may be of a known type that presents a full color graphical display to the passengers. These types of complex displays require the dedicated circuitry of the banner advertisement sign interface devices 182. The banner advertisement sign interface devices 182 are dedicated circuit cards, one for each banner sign 160, that generate the necessary power and data signals to reproduce the desired output on the banner signs 160. The output data is generated and controlled by the CPU 186 and main motherboard 164 as dictated by the software loaded within the computer control system 136 for this purpose. It should be appreciated that several means are available to update and change the display output to the banner signs 180 by changing the data used by the banner display software. In other words, it is possible to change the advertising display data through the Ethernet network for one or all of the interconnected fleet vehicles 112 remotely, or the individual computer control system 136 of the vehicles themselves can be software loaded with changes to the advertising data during maintenance or other down time. The generated data is routed out from the CPU 186 and main motherboard 164 through the serial interface device 176 to the banner advertisement sign interface devices 182. The banner advertisement sign interface devices 182 then convert and process the desired data into digital signals necessary to produce the desired display. The signals are routed through the communications interface device 178, which further routes the data and any required power out to the banner advertisement signs 160. It should be appreciated that one or more of the banner advertisement signs 160 may also be placed on the outside of the vehicle to present an advertising message to the general public.

The main motherboard 164 also has several serial data communication, or COM, ports that are usable to interface with additional serial devices. While the physical design of the main motherboard 164 constitutes the number of these ports, the preferred embodiment currently uses two COM ports while maintaining at least two others in reserve. One COM port in use in the preferred embodiment is used to interconnect with an external modem or telephone (not shown). Specifically, one COM port is designated to interface with a cellular modem/telephone of the known CDPD format. CDPD, or Cellular Digital Packet Data is a specification for supporting wireless access to the Internet and other public packet-switched networks. In this manner, the preferred embodiment supports a communications redundancy that allows the computer control system 136 to connect with its fleet-wide network through a cellular connection either as a backup to, or in substitution of the wireless Ethernet connection described above.

The second COM port in use in the preferred embodiment is for the interface of the fairbox (not shown) of the vehicle 112 with the computer control system 136. As described above, the input from the vehicle fairbox is routed through the systems interconnection box 140 and is then sent to a COM port on the main motherboard 164 of the computer unit 138. The fairbox data provides a means to monitor the fairs received from the passengers, which is stored in the computer unit 138 and it can be later retrieved for ridership analysis, theft prevention and control, or the like. It should be appreciated that the preferred embodiment's use of a COM port to accept serial data from a vehicle fairbox assumes that the fairbox is of a known electronic configuration which produces serial digital data representative of the fares received. If the application requires fairbox input in a different format, such as analog, then the fairbox input can be routed through the communications interface device 178.

In operation of the passenger detection system 110, if one or more passengers enter and/or exit the passenger interior 118 of the vehicle 112, the passenger detection devices 130 detect either the passengers entering and/or exiting when the infrared light beams are broken and sends a signal to the computer unit 138. The computer unit 138 determines whether the passengers were entering and/or exiting by which infrared light beam is broken first. Concurrently, the passenger number devices 132 and 134 detect whether a passenger is in the path of the ultrasonic beam and a signal is captured by the detection interface 135 and sent to the computer 138. The computer 138 determines whether there was a passenger detected by the first passenger numbering device 132 and the second passenger numbering device 134. As a result, the computer 138 can determine whether passengers are entering and/or exiting the passenger interior 118 through the opening 116 and the number of passengers entering and/or exiting to monitor the total number of passengers in the passenger interior 118 of the vehicle 112. It should be appreciated that, for a narrow opening 116 where only one passenger can enter and exit the vehicle 112 at any given time, the passenger numbering devices 132 and 134 would be eliminated.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A passenger detection system for a vehicle having at least one opening to allow passengers to enter and exit the vehicle, said passenger detection system comprising:

a plurality of passenger detection devices adapted to be placed on opposed sides of the at least one opening to detect passengers entering and exiting the vehicle through the at least one opening;

a plurality of passenger number devices adapted to be placed on at least one side of the at least one opening to detect the number of the passengers entering or exiting the vehicle through the at least one opening; and a microprocessor computer control system including a microprocessor computer unit adapted to be disposed within the vehicle in electrical connection with said passenger detection devices and said passenger number devices to receive inputs from said passenger detection devices and said passenger number devices and to process the inputs to determine passenger count and transmit resultant data to a remote location and a systems interconnection adapted to be disposed within the vehicle and electrically connected to said microprocessor computer unit to provide an electrical connection of at least one external component to said microprocessor computer unit.

2. A passenger detection system as set forth in claim 1 wherein said passenger detection devices are of an infrared type.

3. A passenger detection system as set forth in claim 1 wherein said passenger detection devices emit and receive an array of infrared light beams.

4. A passenger detection system as set forth in claim 1 wherein said passenger detection devices are of an ultrasonic type.

5. A passenger detection system as set forth in claim 1 wherein said passenger number devices are of an ultrasonic type.

6. A passenger detection system as set forth in claim 1 wherein said passenger number devices are offset from each other.

7. A passenger detection system as set forth in claim 1 including at least one external component adapted to be mounted to the vehicle and chosen from a group comprising at least one video camera, an audio interface device, at least one advertisement sign, at least one passenger information sign, and an operator interface.

8. A passenger detection system as set forth in claim 7 including an interface electrically interconnecting said computer system and said passenger number devices for capturing signals from said passenger number devices.

9. A passenger detection system as set forth in claim 7 wherein said at least one external component includes a display for displaying the number of passengers entering and exiting.

10. A vehicle comprising:

a bus having a body with at least one opening to allow passengers to enter and exit said bus; and a passenger detection system including a microprocessor computer control system disposed within said body for detecting passengers entering and exiting said bus through said at least one opening and for detecting the number of the passengers entering or exiting said bus through said at least one opening.

11. A vehicle as set forth in claim 10 wherein said passenger detection system includes a plurality of passenger detection devices placed on opposed sides of said at least one opening to detect passengers entering and exiting said bode through said at least one opening.

12. A vehicle as set forth in claim 11 wherein said passenger detection system includes a plurality of passenger number devices placed on at least one side of said at least one opening to detect the number of the passengers entering or exiting said body through said at least one opening.

13. A vehicle as set forth in claim 12 wherein said passenger number devices are of an ultrasonic type.

14. A vehicle as set forth in claim 12 wherein said passenger number devices are disposed on opposed sides of said at least one opening and spaced longitudinally from each other.

15. A vehicle as set forth in claim 12 wherein said computer control system is electrically connected to said passenger detection devices and said passenger number devices.

16. A vehicle as set forth in claim 15 including an interface electrically interconnecting said computer control system and said passenger numbering devices for capturing signals from said passenger numbering devices.

17. A vehicle as set forth in claim 11 wherein said passenger detection devices are of an infrared type.

18. A vehicle as set forth in claim 11 wherein said passenger detection devices emit and receive an array of infrared light beams.

19. A vehicle as set forth in claim 11 wherein said passenger detection devices are of an ultrasonic type.

20. A motor vehicle comprising:

a body having at least one opening to allow passengers to enter and exit;

at least one passenger detection device disposed within said body to detect passengers entering and exiting said at least one opening; and a passenger detection system including a microprocessor computer unit disposed within said body for detecting passengers entering and exiting said body through said at least one opening and for detecting the number of the passengers entering or exiting said body through said at least one opening and a systems interconnection disposed within said body and electrically connected to said microprocessor computer unit to provide an electrical connection of at least one external component to said microprocessor computer unit.

* * * * *

UNITED STATES PATENT AND TRADEMARK OFFICE

CERTIFICATE OF CORRECTION

PATENT NO. : 6,919,804 B1
DATED : July 19, 2005
INVENTOR(S) : Kenneth J. Cook et al.

It is certified that error appears in the above-identified patent and that said Letters Patent is hereby corrected as shown below:

Column 3,
Line 12, "116." should read -- 116 --;

Column 10,
Line 10, delete "or", insert -- and --;
Line 20, after "interconnection", insert -- box --;
Line 23, after "component", insert -- adapted to be connected to the vehicle --;

Column 11,
Line 3, delete "and", insert -- at least one external component connected to said body; and --;
Line 5, delete "control system", insert -- unit --;
Lines 5 and 8, delete "or", insert -- and --;
Line 9, after "opening", insert -- and a systems interconnection box disposed within said body and electrically connected to said microprocessor computer unit and said at least one external component --;

Column 12,
Lines 3-4, after "exit;", insert -- at least one external component connected to said body; --;
Line 11, delete "or", insert -- and --;
Line 12, after "interconnection", insert -- box --;
Lines 14-15, delete "to provide an electrical connection of", insert -- and said --; and
Line 15, after "component", delete "to said microprocessor computer unit".

Signed and Sealed this

Fourth Day of April, 2006

JON W. DUDAS
*Director of the United States Patent and Trademark Office*